US009642437B2

(12) United States Patent
Cox et al.

(10) Patent No.: US 9,642,437 B2
(45) Date of Patent: May 9, 2017

(54) GRAVITY FLOW SPOOL VALVE

(71) Applicants: Stephen Kenneth Cox, Richmond Hill (CA); Swarnjit Chana, Brampton (CA)

(72) Inventors: Stephen Kenneth Cox, Richmond Hill (CA); Swarnjit Chana, Brampton (CA)

(73) Assignee: Seven Continents Corporation

( * ) Notice: Subject to any disclaimer, the term of this patent is extended or adjusted under 35 U.S.C. 154(b) by 13 days.

(21) Appl. No.: 14/806,009

(22) Filed: Jul. 22, 2015

(65) Prior Publication Data

US 2017/0020264 A1 Jan. 26, 2017

(51) Int. Cl.

| | |
|---|---|
| ***B67D 3/00*** | (2006.01) |
| ***A45D 34/00*** | (2006.01) |
| ***B65D 47/06*** | (2006.01) |
| ***B65D 47/24*** | (2006.01) |

(52) U.S. Cl.

CPC ..... *A45D 34/00* (2013.01); *B65D 47/06* (2013.01); *B65D 47/24* (2013.01)

(58) Field of Classification Search

CPC ..... A45D 34/00; B65D 47/06; B65D 47/24; B65D 83/0409; G01F 11/16; G01F 11/10; G01F 11/12; G01F 11/14; G01F 11/22; G01F 11/32

USPC ..... 222/484, 361, 362, 363, 365, 366, 21, 222/344

See application file for complete search history.

(56) References Cited

U.S. PATENT DOCUMENTS

| | | | | | |
|---|---|---|---|---|---|
| 804,468 | A * | 11/1905 | Helmold | B05B 11/3074 | 222/340 |
| 847,000 | A * | 3/1907 | Helmold | A23G 9/28 | 222/332 |
| 1,015,680 | A * | 1/1912 | Hollingsworth | G01F 11/32 | 222/440 |
| 1,349,121 | A * | 8/1920 | Dabrowski | A47K 5/06 | 222/336 |
| 1,455,970 | A * | 5/1923 | Resek | A47K 5/10 | 184/66 |
| 1,529,388 | A * | 3/1925 | Brant | A47K 5/1204 | 222/131 |
| 2,282,110 | A * | 5/1942 | Angell | G01F 11/16 | 222/308 |
| 2,464,030 | A * | 3/1949 | Engstrom | B67D 3/0003 | 222/181.1 |
| 2,659,518 | A * | 11/1953 | Donnelly | G01F 11/32 | 222/449 |

(Continued)

*Primary Examiner* — J. Casimer Jacyna
*Assistant Examiner* — Benjamin R Shaw

(57) ABSTRACT

Disclosed is a gravity flow spool valve for dispensing small volumes of liquid. The valve comprises an elongated hollow housing and a piston adapted to move within the interior of the housing. The piston has a first and second spool, spaced from each other using a coupling rod. The piston is coupled to an activation button which moves the piston from a dispense position to an intake position. In the intake position, the second spool is moved past a series of intake holes in the housing and fluid surrounding the holes flows into the chamber defined between the interior surface of the housing, the first spool and the second spool. When in the dispense position, the chamber is in communication with a spout and a ventilation hole which allows the fluid contained within the chamber to flow out the spout. One application of the valve is dispensing perfume samples.

9 Claims, 7 Drawing Sheets

(56) References Cited

U.S. PATENT DOCUMENTS

| | | | | | |
|---|---|---|---|---|---|
| 3,187,770 | A * | 6/1965 | Plamann | B67D 3/043 | 137/589 |
| 3,907,173 | A * | 9/1975 | Lind | G01F 11/22 | 137/99.5 |
| 5,092,497 | A * | 3/1992 | Toedter | G01F 11/32 | 222/434 |
| 6,811,061 | B2 * | 11/2004 | Tuvim | G01F 11/18 | 222/336 |
| 2002/0108973 | A1 * | 8/2002 | Roethel | B67D 3/043 | 222/518 |
| 2003/0164386 | A1 * | 9/2003 | Connelly | G01F 11/16 | 222/361 |
| 2007/0125807 | A1 * | 6/2007 | Lucas | G01F 11/16 | 222/361 |
| 2012/0292348 | A1 * | 11/2012 | Thulin | G01F 11/18 | 222/361 |

* cited by examiner 7
14
42
28
36
34
9
22
24
6
6
18
6
5
11
26
4
20
40
19
3
27
10
8
21
29
12
25
23
30
41
43
15
17

GRAVITY FLOW SPOOL VALVE

FIELD OF THE INVENTION

The invention pertains to a gravity flow valve. More particularly, the invention pertains to a gravity flow valve for use in dispensing small volumes of liquid.

BACKGROUND OF THE INVENTION

Spool valves are well known mechanisms with particular uses in high pressure applications such as, fuel injection or high speed filling machines. Such pressurized spool valves are not suited for small volumes where a low dispensing flow rate is desired. Furthermore, pressurized spool valves also often require an energy source to power them.

There are applications where a low volume and low flow rates would be advantageous. One such application would be in the individual dispensing of cosmetic samples for personal use. Currently, cosmetic samples, particularly perfume samples, are distributed to consumer via small prepackaged vials containing a small amount of the fluid. In order for a consumer to obtain a sample they must contact a staff member and request a sample vial. Often, sales associates are reluctant to give out such samples or the samples are unavailable. This process of obtaining a sample is typically time consuming or difficult.

An alternative method of distributing perfume samples involves a staff member spraying a small amount of perfume on a slip of paper. This method is suboptimal in that the scent of a particular perfume changes as it reacts with an individual's skin. Thus, spraying the sample on paper does not necessarily represent how scent would smell on a consumer. Additionally, with this method the consumer cannot take home a sample of the perfume to try at a later date.

It would be advantageous to have a method of dispensing perfumes samples where in the consumer can obtain a take home sample of the cosmetic without having to rely on staff involvement. A low volume, low flow rate spool valve could be used for such purpose.

SUMMARY OF THE INVENTION

One aspect of the invention relates to a valve for dispensing small volumes of liquid comprising a hollow elongated sleeve having a first end and a second end, a spout coupled to the housing at the first end and at least one intake hole through the housing at the second end thereof and a piston having a first spool and a second spool spaced a fixed distance from each other via a connecting rod. The first spool and the second spool are adapted to be moveable within and be in sealing engagement with an interior wall of the housing. The first spool, the second spool and the interior wall of the housing define a chamber there between. An activation apparatus is coupled to the piston to move the piston between an intake position and a dispense position. When the piston is in the intake position, the chamber is in communication with the at least one intake hole and isolated from the spout and the ventilation hole to allow the flow of fluid surrounding the at least one intake hole to enter the chamber. When the piston is moved to the dispense position, the chamber is in communication with the spout and ventilation hole and isolated from the at least one intake hole to allow the fluid within the chamber to flow out the spout.

In a further aspect of the invention, the valve further comprises a spring chamber coupled to the second end of the housing containing a spring therein; the spring having a first end and a second end. The first end is adjacent the second spool of the piston and second end is adjacent an end wall of the spring chamber. When the piston is moved to the intake position, the spring is compressed between the second spool and the end wall of the chamber, and the decompression of the spring moves the piston from the intake position to the dispense position.

In yet a further aspect of the invention, the activation apparatus is an activation button and depression of the activation button moves the piston to the intake position and release of the activation button allows the spring decompress to move the piston to the dispense position.

In another aspect of the invention, the at least one intake hole is a series of intake holes spaced about the circumference of the housing.

In yet another aspect of the invention, the valve further includes a pair of wing supports for a user's fingers when depressing the activation button.

In a further aspect of the invention, a coil is wrapped about the connecting rod to occupy volume and clipping part of the coil provides a simple method of adjusting the volume of liquid to be dispensed.

In a preferred embodiment of the invention, the spout is straight.

In another aspect of the invention, the valve is mounted in a display having an interior volume for holding liquid cosmetic products. The valve is mounted such that the intake holes are in communication with the interior volume and the spout and ventilation hole provided on the exterior of the display.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
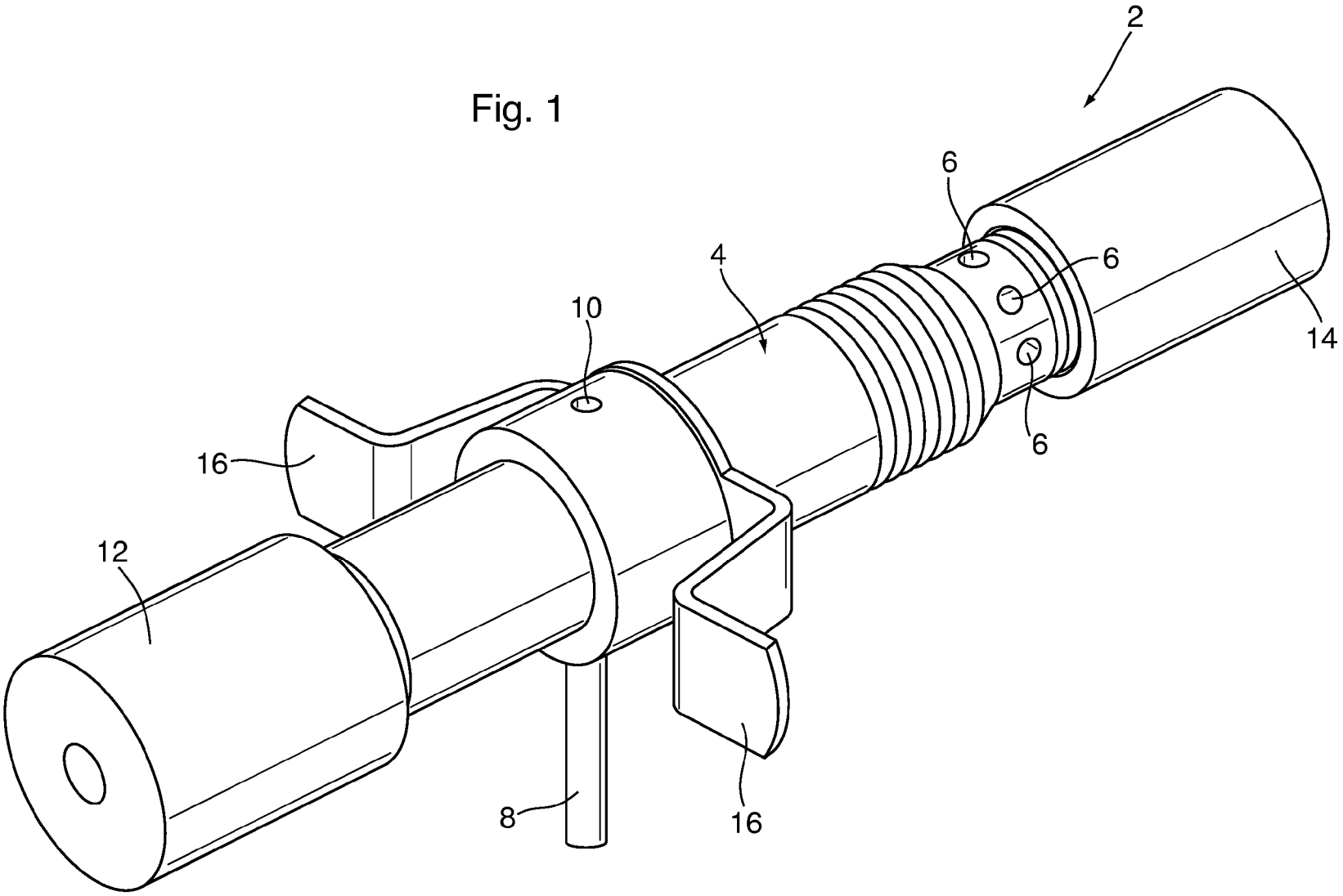
FIG. 1 depicts a perspective view of the gravity flow valve of the present invention.

FIG. 1 shows a preferred embodiment of the gravity flow valve 2 of the current invention. Although the valve could be adapted for a variety of volumes, the preferred use is for low-speed and precise dispensing of small volumes of liquid in the range of 0.5 to 5 ml. Dispensing a volume of 1 ml-3 ml has particular use in the cosmetic industry for dispensing perfume samples.

Figure 2:
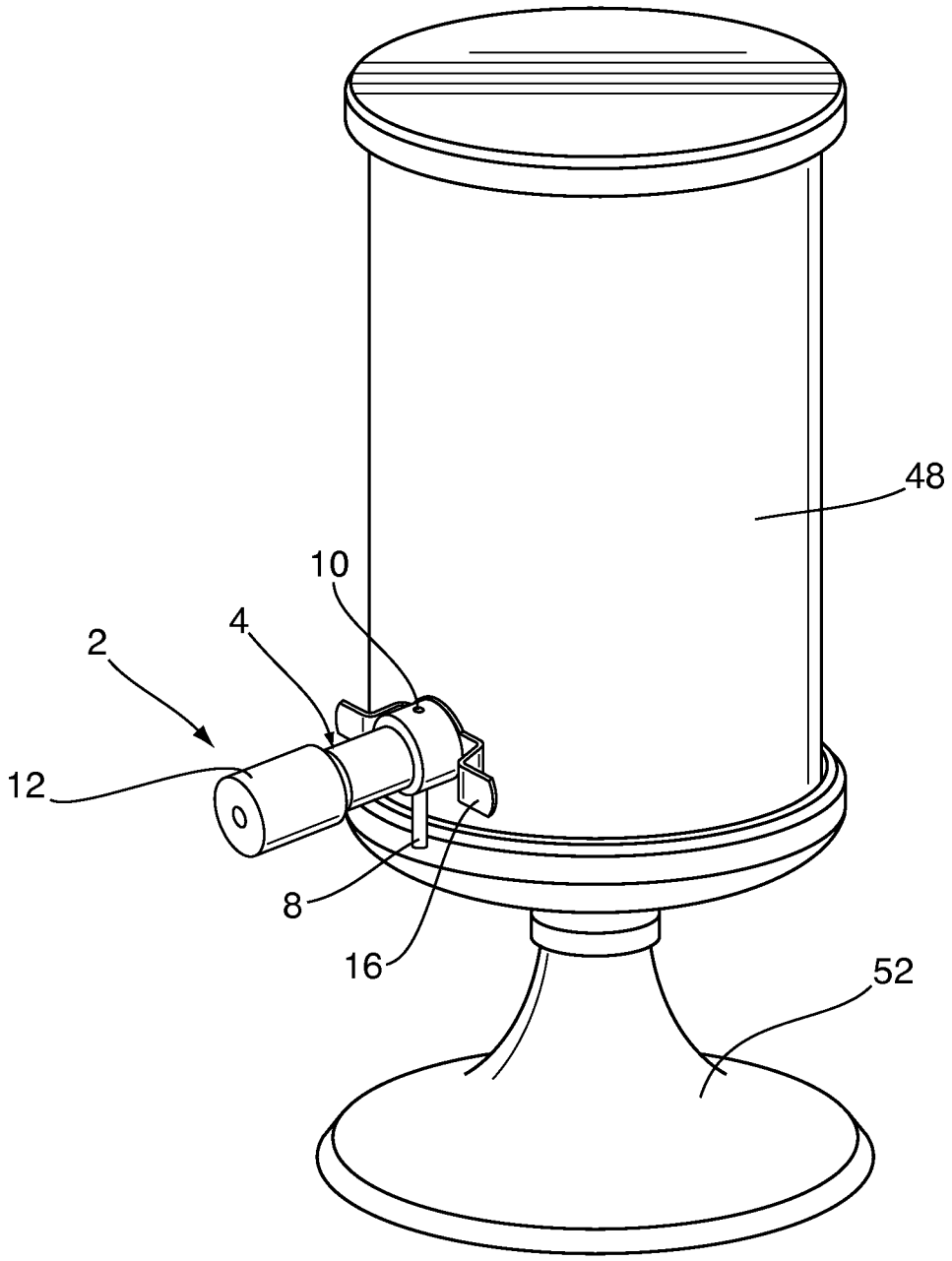
FIG. 2 depicts the gravity flow valve mounted in a dispensing display.
Figure 3:
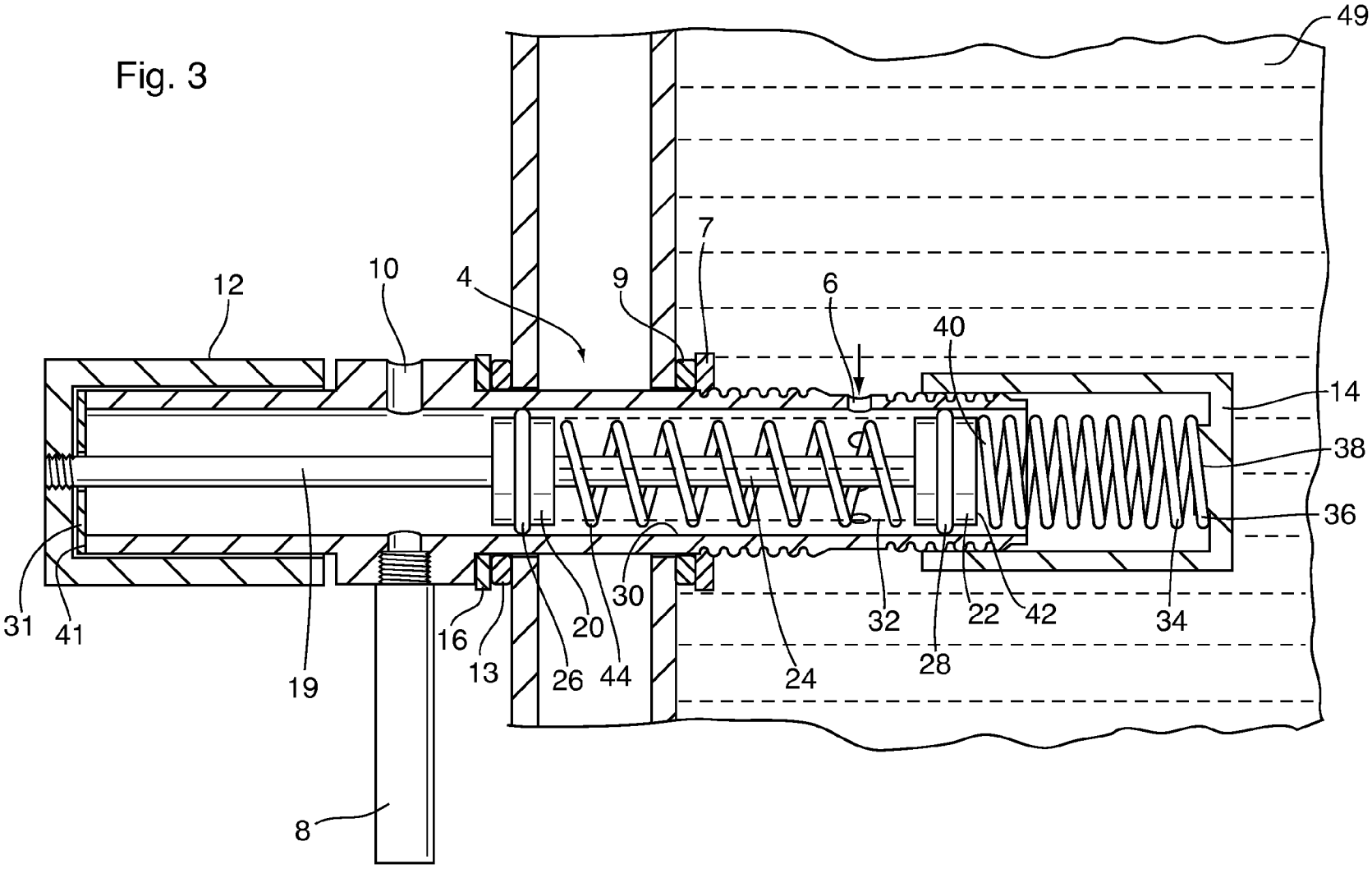
FIG. 3 depicts a cross sectional view of the gravity flow valve in the intake position when submersed in a volume of liquid.

FIG. 2 shows the valve 2 mounted to a reservoir 48 containing liquid 49, as shown in FIG. 3. The valve 2 is mounted in the horizontal position with the front portion extending outwardly from the reservoir 48 and the rear portion submersed within the liquid 49 contained in the interior of the reservoir 48. The front portion is accessible on the exterior of the reservoir 48. It should be noted that FIG. 3 shows a double-walled reservoir however the valve could be adapted for other reservoir configurations particularly single-walled reservoirs.

Figure 4:
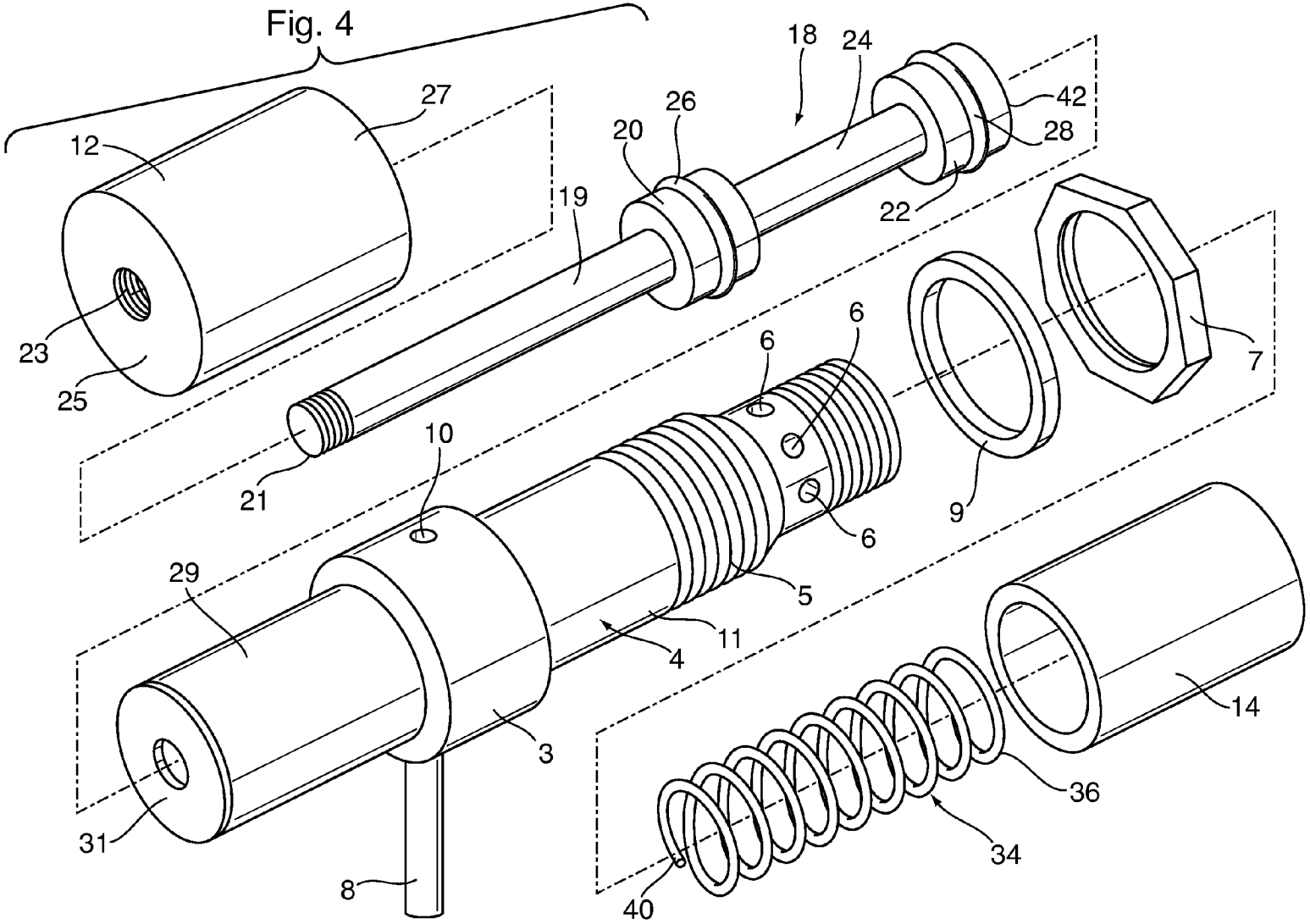
FIG. 4 depicts an exploded view of the gravity flow valve assembly.

The exploded view shown in FIG. 4 depicts the assembly of the valve. When in use, a user depresses the activation button 12, to move the piston 18 from a dispense position to an intake position, which allows fluid to enter a chamber between two spools mounted on the piston, as described below. Upon release, the spring 34 pushes the piston and contents of the chamber back to the dispense position and the contents of the chamber are allowed to drain through spout 8. As shown in FIGS. 1 and 2, the valve optionally includes a pair of wings 16 around which a user can hook index and middle finger to aid in depressing the activation button 12 with their thumb.

The valve 2 has two ends, one where the activation button 12 is located, and one where the spring chamber 14 is connected. For simplicity, the activation button end will be defined as forward while the spring chamber end defines the rear of the valve 2.

The housing 4 of the valve 2 includes an enlarged portion 3 to which the spout 8 is mounted and through which the ventilation hole 10 extends. When mounted to a reservoir 48, as shown in FIG. 2, the enlarged portion 3 abuts the exterior of the reservoir 48 and the remainder of the housing 4 rearward of the enlarged portion extends into the reservoir as shown in FIG. 3. In a preferred embodiment, a sealing gasket 13 is positioned between the enlarged portion 3 and the exterior wall of the reservoir. In an embodiment where wings 16 are used, the wings 16 abut the enlarged portion and either sealing gasket 13 is adjacent the wings and the exterior wall of the reservoir or the wings are directly adjacent to the exterior of the reservoir 48. Alternatively, a spacer could be used to adjust the distance between the wings and the reservoir 48.

The housing includes a smooth portion 11, located rearward of the enlarged portion 3, the length of which generally corresponds to the thickness of the reservoir wall. To the rear of the smooth portion is a series of threads. When the valve 2 is mounted in a reservoir, a sealing gasket 9 is placed over the threads on to the smooth portion and against the interior wall of the reservoir. A threaded fastening nut 7 is then used to compress the sealing gasket 9 against the interior wall and about the housing to create a seal between the valve 2 and the reservoir as shown in FIG. 3.

Figure 5:
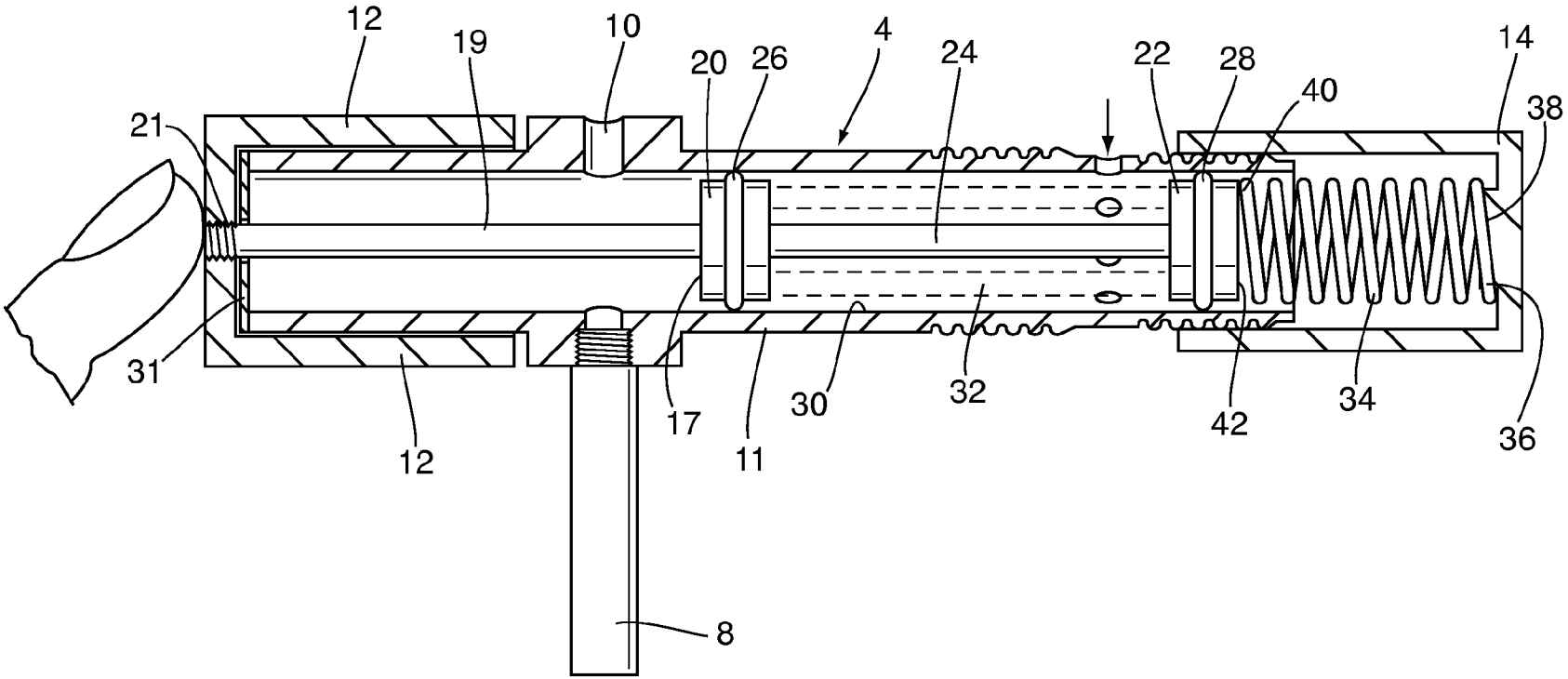
FIG. 5 depicts a cross sectional view of the gravity flow valve in the intake position.

In reference to FIG. 4, the housing 4 is an elongated hollow tube having a plurality of intake holes 6 at one end thereof. The spout 8 and ventilation hole 10 are provided at a second end of the housing. A piston 18, adapted to be movable within the interior of the housing 4, has a first spool 20 and second spool 22. The first spool 20 and second spool 22 are spaced a fixed distance from each other and are coupled together by a coupling rod 24. Each of the first spool 20 and second spool 22 have a first gasket 26 and second gasket 28 around the circumference of each spool respectively. This creates a seal between the spools 20 and 22 and the interior surface 30 of housing 4. The first spool 20 second spool 22 and inside surface 30 of the housing 4 define a movable chamber 32 therebetween as shown in FIG. 5. Since the first spool 20 and the second spool 22 are fixed relative to each other, the volume of the chamber 32 remains constant as the piston is moved within the housing 4.

An activation button 12 is coupled to the piston 18 by extension rod 19. The activation button 12 has a circular end surface 25 and a wall 27 extending perpendicularly outward from the perimeter of the end surface 25, making it a hollow cylinder which is closed at one end. The activation button 12 is sized such that the interior diameter of the wall 27 is greater than the outer diameter of the front portion 29 of the housing 4. Thus, when the activation button 12 is depressed, the wall 27 slides over the front portion 29 of the housing 4. In a preferred embodiment, the circular end 25 abuts the housing 4 to define the end of the stroke length of the piston 18. Although there are various ways known to a person skilled in the art to couple the activation button 12 to the coupling rod 19, the embodiment shown in the Figures uses a threaded male portion 21 of the coupling rod 19 adapted to screw into a female threaded hole 23 in the center of the end surface 25 of activation button 12.

A spring chamber 14 is coupled to the housing 4 at the rear end thereof. FIG. 3, depicts a spring 34, with a first end 36 adjacent to the inside surface 38 of spring chamber 14, and second end 40 adjacent to the rear surface 42 of the second spool 22. The spring chamber and spring are preferably coupled to the housing 4 via external threading on the housing 4 which cooperates with internal threading on the interior surface of the spring chamber 14.

Figure 6:
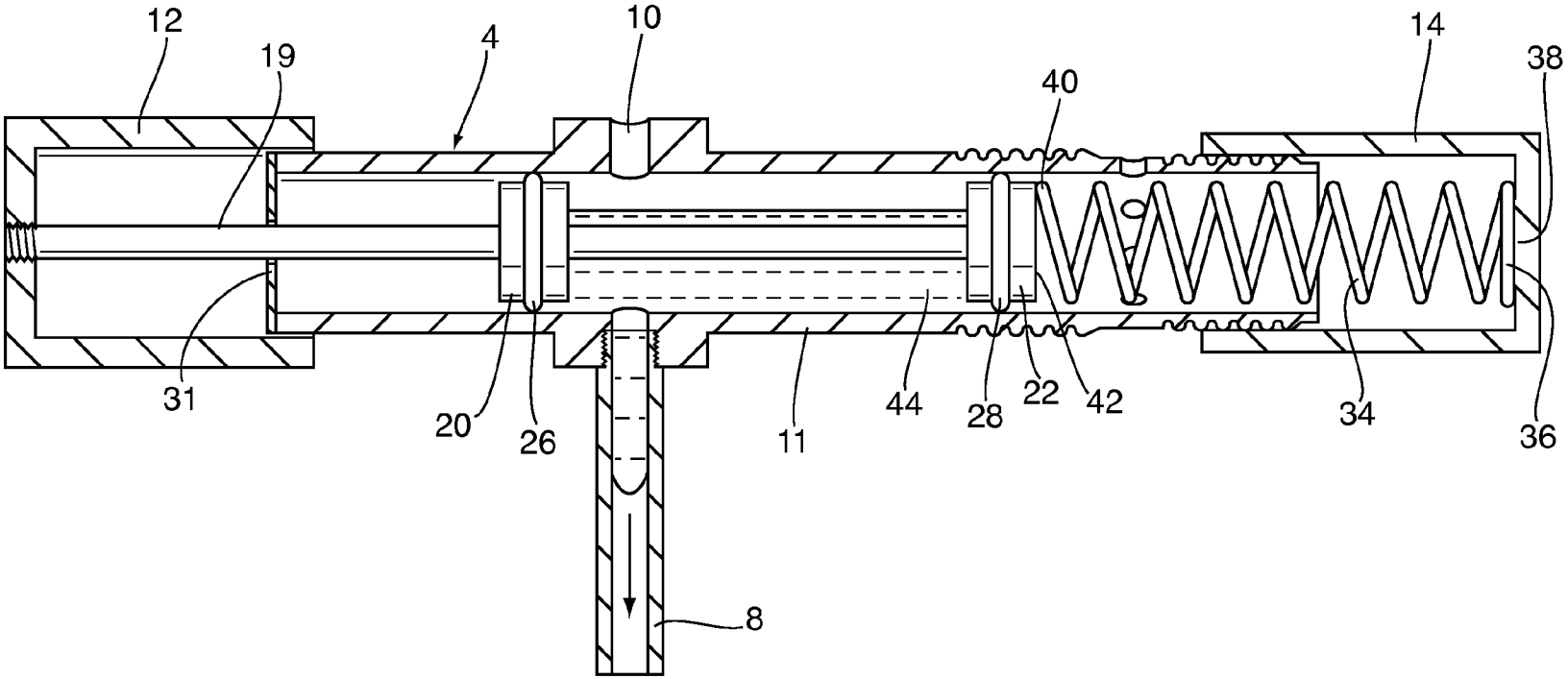
FIG. 6 depicts a cross sectional view of the gravity flow valve in the dispense position.

The piston 18 is movable between an intake position, as shown in FIG. 5, and dispense position, as shown in FIG. 6. The dispense position is the neutral position of the valve. Upon depression of the activation button 12, the piston 18 is moved from the dispense position into the intake position. In this position, the second spool 22 is located rearward of the intake holes 6, allowing fluid surrounding the intake holes to enter into the chamber 32. The length of the connecting rod 24 is shorter than the distance between the spout and the intake holes. As such, in the intake position, the first spool 20 is moved rearward of the spout 8. In the intake position the intake holes 6 are in communication with the chamber 32 while the spout 8 and ventilation holes 10 are sealed off from the chamber 32. The volume of liquid contained within the chamber at the end of the depression stroke of the piston is generally equal to the volume of the chamber 32.

In a preferred embodiment there are multiple intake holes 6 to allow air within the chamber to be released through some of the holes, while still allowing liquid to enter through other intake holes. The preferred embodiment in the figures includes intake holes spaced evenly about the circumference of the housing 4. The preferred diameter of the intake holes is in the range of 0.15 to 0.17 inches based on a housing diameter of approximately 0.4-0.5 inches. If the intake holes are too small air bubble release is inhibited. If the intake holes are too large the structural integrity of the housing is compromised. In the dispense position, fluid can flow into the spring chamber through the intake holes. The movement of the pistons to the intake position pushes the liquid in the spring chamber out of the intake holes 6 back into the reservoir 48. Alternatively, holes could be provided in the walls or end of the spring chamber to allow the fluid in the spring chamber to flow out.

Upon depression of the activation button 12, the spring 34 is compressed between the rear surface 42 of the second spool and the inside surface 38 of the spool chamber 14. Upon release of the activation button, the spring 34 decompresses pushing the piston forward towards the spout and into the dispense position shown in FIG. 6. In doing, so the liquid contained within the chamber 32 is also moved forward within the housing 4.

FIG. 6 shows the piston in the dispense position. In this position, the first spool 20 is located forward of the spout 8 and ventilation hole 10 and the rear spool 22 is located forward of the intake holes 6, effectively sealing the chamber 32 from liquid 49 in the reservoir 48. To facilitate dispensing, the spout 8 and ventilation hole 10 are in communication with the chamber 32. As the first spool 20 moves past the spout 8 and ventilation hole 10, the fluid 44 contained within the chamber flows out through the spout 8. As the fluid flows out through spout 8, air enters the chamber through ventilation hole 10.

Figure 7:
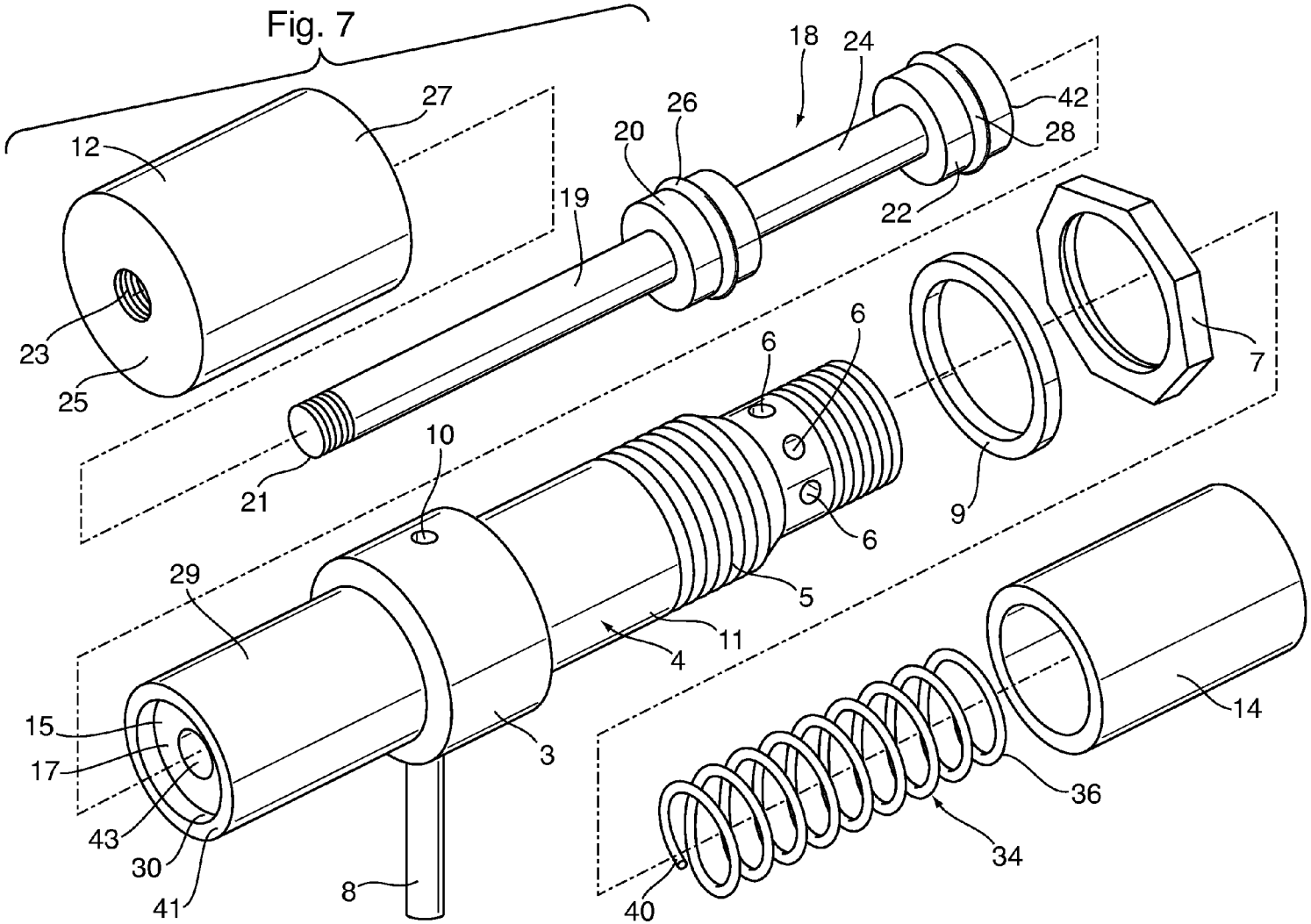
FIG. 7 depicts an exploded view of the gravity flow valve assembly with a stopper to inhibit removal of the piston.

In use, the rear spool 22 effectively seals the liquid in the reservoir. If the piston were to be removed from the housing, liquid in the reservoir would freely flow out. To prevent the removal of the piston, a metal plate is used. The metal plate 15 is fixed to the front edge 41 of the housing 4 and has a channel 23 through which the extension rod 19 of the piston 18 can freely pass. The piston is stopped when the leading edge 17 of the first spool 20 abuts the interior surface 21 of the metal plate 15. Alternatively, a stopper can be fitted within the front portion 29 of the housing 4 to stop the removal of the piston. Similar to the metal plate embodiment the stopper has a channel 43 through which the extension rod 19 of the piston 18 can freely pass. This embodiment is shown in FIG. 7.

In a preferred embodiment the valve is made of metal, particularly stainless steel or aluminum, however, other metallic materials would be known to a person skilled in the art. Alternatively, the valve could be made of plastic materials, preferably injection moulded plastics.

It can be appreciated that with this particular design, gravity is utilized to allow the fluids to flow into the chamber through the intake holes and out of the spout 8. There is no need to pressurize the chamber 32 to initiate flow of the fluid contained within and a power source is not necessary.

In a preferred embodiment the valve 2 is used for dispensing viscus or liquid cosmetics, particularly samples of perfume. As can be appreciated the volume of the chamber 32 defines the volume of fluid that will be dispensed through spout 8. Thus, it follows that the interior diameter of the housing 4, the diameter of the connecting rod 24 and spacing of the first spool 20 from the second spool 22, are the factors which define the volume of the chamber 32 and are fixed for any particular valve. On occasion, it may be necessary to adjust the volume of liquid to be dispensed in a timely manner, without having to manufacture a new valve. FIG. 3 shows a spring 44 (shown as uncompressed, although a compressed spring would be possible) wrapped about the connecting rod 24 between the first spool 20 and second spool 22. The purpose of the spring 44 is simply to occupy volume of the chamber 32. If the client wishes to increase the volume of liquids to be dispensed, the effective volume of the chamber 32 can be adjusted by cutting a portion of the spring and removing it from the chamber. This is advantageous as the volume of liquid to be dispensed can be changed in a time effective manner without requiring large structural changes to the valve itself.

In a preferred embodiment, the valve is used to dispense perfume samples into small vials for consumer use. As shown in FIG. 2, the valve can be mounted to a display. The display has a reservoir 48 for holding a volume of perfume to be dispensed. In order to provide more convenient access to the spout 8, the display assembly can optionally be mounted on top of a pedestal 52.

This design is particularly advantageous in that it dispenses small volumes of liquid with precision and repeatability. This is an asset when dispensing perfume samples as it is desirable that the small volume vials do not overflow. Overflowing vials are costly to the provider of the samples and potentially aggravating to the consumer who would get perfume on their hands.

This display and method of dispensing perfume samples, is advantageous in that consumers wishing to sample a particular perfume can dispense their own sample into a small vial, without having to wait for a sales associate to help them. Furthermore, this particular method of dispensing perfume samples can replace the traditional method of spraying perfume on a paper card, which has a downfall of not truly representing how the scent would change when applied to a consumer's skin. Additionally, there is no need for staff to be present to fulfill requests for individual prepackaged sample vials which are typically difficult for the consumer to obtain.

The scope of the claims should not be limited by the preferred embodiments set forth in the examples, but should be given the broadest interpretation consistent with the description as a whole.

The embodiments of the invention in which an exclusive property or privilege is claimed are defined as follows:

1. A valve for dispensing small volumes of liquid comprising:

a housing having a hollow elongated sleeve with a first end and a second end;

a spout and associated ventilation hole coupled to the housing at the first end and at least one intake hole through the housing at the second end thereof;

a piston having a first spool and a second spool spaced a fixed distance from each other via a connecting rod; said first spool and said second spool adapted to be moveable within and be in sealing engagement with an interior wall of the said housing; said first spool, said second spool and said interior wall of said housing define a chamber there between; and an activation apparatus coupled to said piston to move said piston between an intake position and a dispense position; wherein when said piston is in the intake position, said chamber is in communication with said at least one intake hole and isolated from said spout and said ventilation hole to allow the flow of fluid surrounding the at least one intake hole to enter the chamber; and when said piston is moved to said dispense position, said chamber is in communication with said spout and said ventilation hole and isolated from said at least one intake hole to allow the fluid within the chamber to flow out the spout; and wherein a coil is wrapped about the connecting rod to occupy volume.

2. A valve as claimed in claim 1 comprising a spring chamber coupled to the second end of said housing containing a spring therein; said spring having a first end and a second end, said first end being adjacent the second spool of said piston and said second end being adjacent an end wall of said spring chamber; wherein when said piston is moved to the intake position, the spring is compressed between said second spool and said end wall of said spring chamber, and the decompression of the spring moves the piston from the intake position to the dispense position.

3. A valve as claimed in claim 2 wherein the activation apparatus is an activation button and depression of the activation button moves said piston to the intake position and release of the activation button allows said spring to decompress and move said piston to said dispense position.

4. A valve as claimed in claim 3 wherein the at least one intake hole is a series of intake holes spaced about the circumference of the housing.

5. A valve as claimed in claim 4 wherein the valve further includes a pair of wing supports for a user's fingers when depressing the activation button.

6. A valve as claimed in claim 1 wherein said spout is straight.

7. A valve as claimed in claim 6 wherein said valve is sized to dispense small volumes in the range of 1 ml to 3 ml.

8. A valve as claimed in claim 7 wherein the valve is mounted in a display having an interior volume for holding liquid; said valve being mounted such that the intake holes are in communication with the interior volume and the spout and ventilation hole provided on the exterior of the display.

9. A valve as claimed in claim 8 wherein the liquid is a cosmetic product.

* * * * *